US011302271B2

(12) United States Patent
Shi et al.

(10) Patent No.: US 11,302,271 B2
(45) Date of Patent: Apr. 12, 2022

(54) METHOD FOR DRIVING DISPLAY PANEL, DRIVING DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lingyun Shi, Beijing (CN); Dong Chen, Beijing (CN); Guangquan Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 216 days.

(21) Appl. No.: 16/064,105

(22) PCT Filed: Dec. 7, 2017

(86) PCT No.: PCT/CN2017/114905
§ 371 (c)(1),
(2) Date: Jun. 20, 2018

(87) PCT Pub. No.: WO2018/126836
PCT Pub. Date: Jul. 12, 2018

(65) Prior Publication Data

US 2021/0166640 A1 Jun. 3, 2021

(30) Foreign Application Priority Data

Jan. 6, 2017 (CN) ..... 201710011269.3

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 2310/027* (2013.01)

(58) Field of Classification Search
CPC combination set(s) only.
See application file for complete search history.

(56) References Cited

U.S. PATENT DOCUMENTS

2011/0187758 A1* 8/2011 Miyake ..... G09G 3/3648 345/690
2012/0176359 A1 7/2012 Xiao et al.
(Continued)

FOREIGN PATENT DOCUMENTS

CN 1641737 A 7/2005
CN 1797527 A 7/2006
(Continued)

OTHER PUBLICATIONS

Wenyang liu CN 102708835 English translation (Year: 2012).*
(Continued)

*Primary Examiner* — Van N Chow
(74) *Attorney, Agent, or Firm* — Calfee, Halter & Griswold LLP

(57) ABSTRACT

A method for driving display panel and a driving device are disclosed. A transition period is inserted between displaying two neighboring frames, pixels in the nth row to the Nth row of the display panel are switched on simultaneously in the transition period, and a voltage with the highest grayscale is applied to the pixels which are switched on. This is equivalent to turning the grayscale of pixels in the nth row to the Nth row into the highest grayscale after displaying a frame and before displaying a next frame. This can improve the
(Continued)

response time of pixels in the nth row to the Nth row during displaying the next frame, and thus can increase the display quality of the display panel.

6 Claims, 2 Drawing Sheets

(56) References Cited

U.S. PATENT DOCUMENTS

| | | | | |
|---|---|---|---|---|
| 2013/0021385 | A1* | 1/2013 | Hou | G09G 3/3659 345/690 |
| 2014/0015820 | A1* | 1/2014 | Choi | G09G 3/3614 345/211 |
| 2016/0140894 | A1* | 5/2016 | Eun | H04N 13/341 345/212 |

FOREIGN PATENT DOCUMENTS

| | | | |
|---|---|---|---|
| CN | 101673528 | A | 3/2010 |
| CN | 102592552 | A | 7/2012 |
| CN | 102798835 | A | 10/2012 |
| CN | 106847207 | A | 6/2017 |
| KR | 20090054842 | A | 6/2009 |

OTHER PUBLICATIONS

Second Office Action for Chinese Patent Application No. 201710011269.3 dated Nov. 15, 2018.

Search Report and Written Opinion for International Application No. PCT/CN2017/114905 dated Feb. 26, 2018.

First Office Action Report for Chinese Patent Application No. 201710011269.3 dated Jun. 5, 2018.

* cited by examiner

METHOD FOR DRIVING DISPLAY PANEL, DRIVING DEVICE

RELATED APPLICATIONS

The present application is the U.S. national phase entry of PCT/CN2017/114905, with an international filing date of Dec. 7, 2017, which claims the benefit of Chinese Patent Application No. 201710011269.3, filed Jan. 6, 2017, the entire disclosure of which is incorporated herein by reference.

TECHNICAL FIELD

The present disclosure relates to the field of display technologies, and particularly to a method for driving a display panel, and a driving device.

BACKGROUND

A liquid crystal display generally comprises an upper substrate and a lower substrate which are assembled, and a liquid crystal molecule layer between the upper substrate and the lower substrate. During displaying an image, an electric field is formed due to a drive voltage applied to a pixel electrode of respective pixels and a common electrode voltage applied to a common electrode. Liquid crystal molecules are deflected under the action of the electric field. Different deflection degrees lead to different transmittances for realizing image display.

Due to the viscous effect of liquid crystal molecules, the liquid crystal molecules take a time to deflect to an expected state, which is called a response time. In the case of a long response time, pixels will be charged at a low rate, and this affects the display quality of the liquid crystal display. As for the virtual reality display, a slow response rate will cause a mismatch between the images seen by eyes and the rotation of the head and eye balls, thus causing discomfort.

SUMMARY

Embodiments of the present disclosure provide a method for driving a display panel, wherein a transition period is inserted between displaying two neighboring frames, at least one row of pixels of the display panel are switched on in the transition period, and a voltage with the highest grayscale is applied to the pixels which are switched on. By switching on at least a row of pixels in the transition period, this facilitates improving the response time of this row of pixels.

For example, in the driving method according to embodiments of the present disclosure, pixels in the nth row to the Nth row of the display panel are switched on in the transition period. N is an integer and indicates a row number of the last row of pixels of the display panel, and n is an integer larger than 0 and smaller than N. The highest grayscale is determined by a bit number M of image data of the display panel, and the highest grayscale is $2^M-1$.

For example, in the driving method according to embodiments of the present disclosure, the pixels in the nth row to the Nth row are switched on simultaneously in the transition period. In the driving method, the pixels in the nth row to the Nth row can be switched on in an interlaced manner. Further, pixels of the nth row to the Nth row can be switched on simultaneously, and this facilitates decreasing the transition period to prevent affecting display.

For example, in the driving method according to embodiments of the present disclosure, the transition period has a duration of 1 H-10 H, and 1 H indicates the time the display panel takes to scan a row of pixels during displaying a frame.

In another example, the driving method according to embodiments of the present disclosure further comprises: switching off a backlight of the display panel in the transition period.

In another example, in the driving method according to embodiments of the present disclosure, n is an integer smaller than N/2.

In yet another example, in the driving method according to embodiments of the present disclosure, n=1.

In another example, in the driving method according to embodiments of the present disclosure, displaying a frame of the display panel comprises:

in a scanning period, progressively scanning pixels in the first row to the Nth row of the display panel; and in a holding period, putting pixels in a respective row of the display panel in a holding state, and switching on the backlight of the display panel.

In another example, the driving method according to embodiments of the present disclosure further comprises: switching off the backlight of the display panel in the scanning period.

Embodiments of the present disclosure further provide a driving device for a display panel, comprising: gate driver circuit, which is electrically connected with gate lines of the display panel, and is configured to apply a switch-on signal to at least one of the gate lines of the display panel in a transition period between displaying two neighboring frames, to switch on a row of pixels corresponding with the at least one gate line; and source driver circuits, which are electrically connected with data lines of the display panel, and are configured to apply a voltage with the highest grayscale to pixels which are switched on in the transition period.

For example, in the driving device in an embodiment of the present disclosure, the gate driver circuits are configured to switch on pixels in the nth row to the Nth row of the display panel in the transition period, N is an integer and indicates a row number of the last row of pixel of the display panel, and n is an integer larger than 0 and smaller than N.

In another example, in the driving device in an embodiment of the present disclosure, the gate driver circuits are configured to switch on the pixels in the nth row to the Nth row simultaneously in the transition period.

In another example, in the driving device in an embodiment of the present disclosure, the transition period has a duration of 1 H-10 H, and 1 H indicates the time the display panel takes to scan a row of pixels during displaying a frame.

DETAILED DESCRIPTION OF EMBODIMENTS

The present disclosure will be described in detail hereinafter with reference to the accompanying drawings and specific implementations for purpose of better conveying technical solutions of the present disclosure to one skilled in the art.

Figure 1:
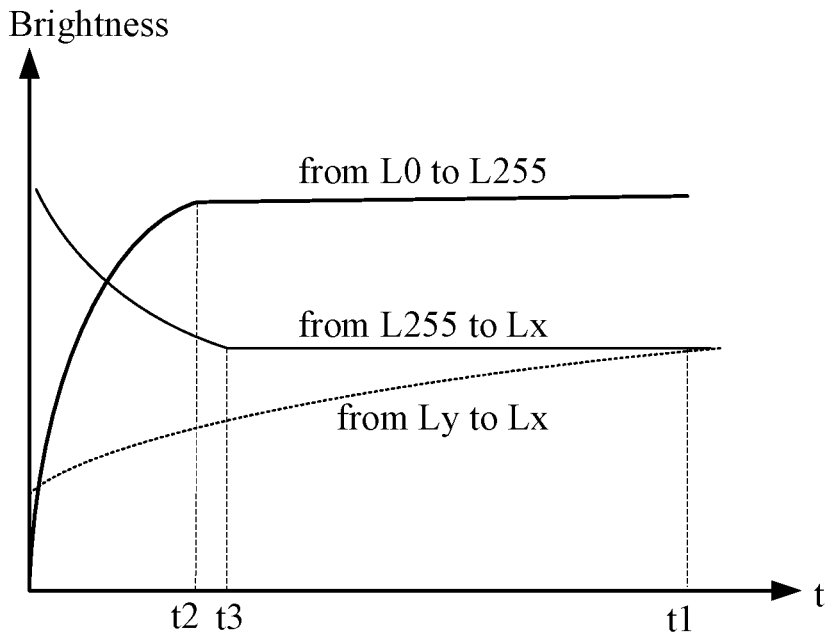
FIG. 1 is a view for illustrating response time for different grayscale conversions according to embodiments of the present disclosure.

It was found by research that the response time of a display panel from a grayscale of L0 to Lx or from Lx to Ly is much longer than the response time from L0 to L255, from L255 to L0, or from L255 to Lx. Lx and Ly indicate two different grayscales which are larger than 0 and smaller than 255. The simulation results of this research are shown in FIG. 1. As can be seen in FIG. 1, the response time t2 from L0 to L255 and the response time t3 from L255 to Lx are much shorter than the response time t1 from Ly to Lx.

Figure 2:
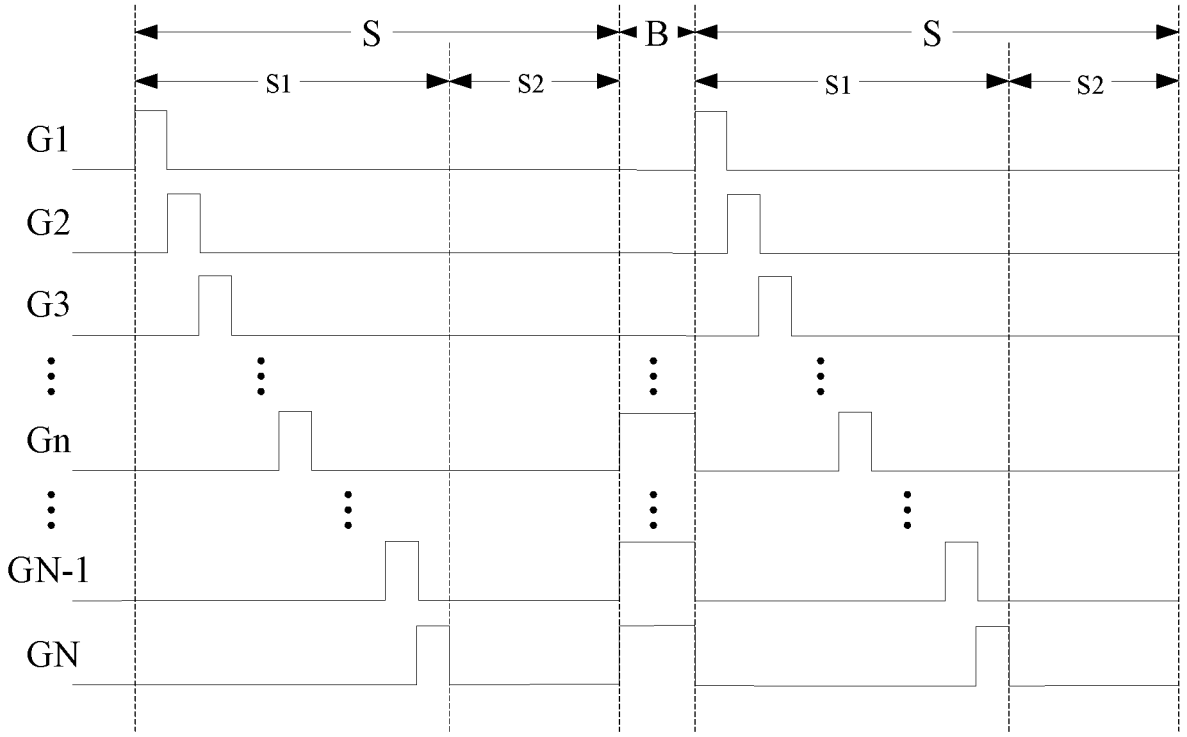
FIG. 2 is a schematic view for illustrating a driving method in an embodiment of the present disclosure.

On basis of this research result, in an embodiment of the present disclosure, a method for driving display panel is provided. As shown in FIG. 2, a transition period B is inserted between displaying two neighboring frames S, and pixels Gn to GN in the nth row to the Nth row of the display panel are switched on simultaneously in the transition period B. A voltage with the highest grayscale is applied to the pixels Gn to GN which are switched on. N is an integer and indicates the row number of the last row of pixels GN of the display panel, and n is an integer larger than 0 and smaller than N.

In the driving method according to embodiments of the present disclosure, the transition period is inserted between displaying two neighboring frames, pixels in the nth row to the Nth row of the display panel are switched on simultaneously in the transition period, and a voltage with the highest grayscale is applied to the pixels which are switched on. This is equivalent to turn the grayscale of pixels in the nth row to the Nth row into the highest grayscale after displaying a frame and before displaying a next frame. This can improve the response time of pixels in the nth row to the Nth row during displaying the next frame, and thus can increase the display quality of the display panel.

In practical applications, generally in a display panel, since the second half of panel is scanned late in time, the response time has a strong impact on the second half of panel. Thus, for example, in the driving method in an embodiment of the present disclosure, n is an integer smaller than N/2. This enables to apply a voltage with the highest grayscale to at least pixels of the second half of panel in the transition period.

In implementations, in the driving method in an embodiment of the present disclosure, n=1. Namely, a voltage with the highest grayscale is applied to pixels of the whole panel in the transition period.

In implementations, in the driving method in an embodiment of the present disclosure, the highest grayscale is $2^M-1$, wherein M is a bit number image data of the display panel. For example, in case M=8, the highest grayscale is 255.

In implementations, in the driving method in an embodiment of the present disclosure, a duration of the transition period is controlled to 1 H-10 H. 1 H indicates the time the display panel takes to scan a row of pixels during displaying a frame. If the transition period it too long, it tends to be perceived by eyes. If the transition period is too short, pixels which are switched on will not timely reach the highest grayscale.

Figure 3:
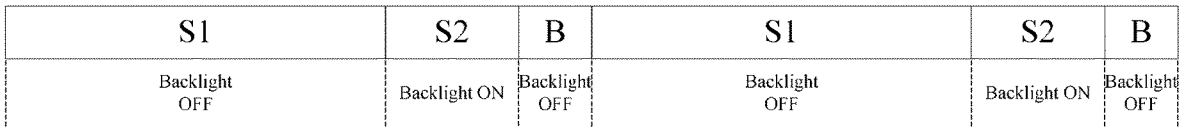
FIG. 3 is a schematic view for illustrating a driving method in an embodiment of the present disclosure.

For example, in an embodiment of the present disclosure, as shown in FIG. 3, the driving method further comprises: switching off a backlight of the display panel in the transition period B. This can prevent the transition period from affecting visual effect.

Virtual reality display poses strict requirement on the response time of the display panel. Thus, in implementations, the driving method according to embodiments of the present disclosure has better result when it is applied to virtual reality display.

For example, in the driving method in an embodiment of the present disclosure, as shown in FIG. 2, displaying a frame S of the display panel comprises:

in a scanning period S1, progressively scanning (scanning row by row) the first row of pixels G1 to the Nth row of pixels GN of the display panel; and in a holding period S2, putting pixel G1-GN in respective row of the display panel in a holding state, and switching on the backlight of the display panel.

For example, in the driving method in an embodiment of the present disclosure, as shown in FIG. 3, the method further comprises: in a scanning period S1, switching off the backlight of the display panel. This facilitates dizzy effect on a human during progressively scanning.

Figure 4:
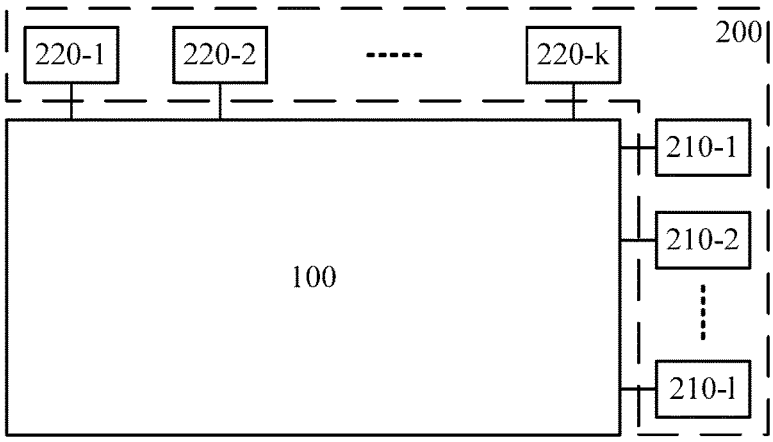
FIG. 4 is a schematic view for illustrating a driving device for a display panel in an embodiment of the present disclosure.

Based on the same inventive concept, embodiments of the present disclosure further provide a driving device for a display panel. As shown in FIG. 4, the driving device 200 comprises gate driver circuits 210-1, 210-2, 210-1 and source driver circuits 220-1, 220-2, **220-*k*. The gate driver circuits are electrically connected with gate lines (not shown) of the display panel 100**, and are configured to switch on one of the gate lines of the display panel in the transition period between displaying two neighboring frames, so as to switch on a row of pixels corresponding with said gate line. For example, when it is desired to switch on a certain gate line, this gate line is switched on by a sub-circuit in the gate driver circuits which corresponds with the gate line. The source driver circuits are electrically connected with data lines of the display panel (not shown), and are configured to apply a voltage with the highest grayscale to pixels which are switched on in the transition period.

Implementations of the above driving method are also applicable to the driving device for the display panel, which are not repeated for simplicity.

In implementations, the method for driving display panel and the driving device in embodiments of the present disclosure can be applied to a virtual reality device.

According to the method for driving display panel and the driving device in embodiments of the present disclosure, a transition period is inserted between displaying two neighboring frames, pixels in the nth row to the Nth row of the display panel are switched on simultaneously in the transition period, and a voltage with the highest grayscale is applied to the pixels which are switched on. This is equivalent to turn the grayscale of pixels in the nth row to the Nth row into the highest grayscale after displaying a frame and before displaying a next frame. This can improve the response time of pixels in the nth row to the Nth row during displaying the next frame, and thus can increase the display quality of the display panel.

To the extent a person with ordinary skill in the art can make various modifications and variations to the present disclosure without departing from the spirit and the scope of the present disclosure, the present disclosure also intends to encompass these modifications and variations.

What is claimed is:

1. A method for driving a display panel, wherein a transition period is inserted between displaying two neighboring frames, pixels in the nth row to the Nth row of the display panel are switched on simultaneously in the transition period, and a voltage with the highest grayscale is applied to the pixels which are switched on, wherein N is an integer and indicates a row number of the last row of pixels of the display panel, and n is an integer larger than 0 and smaller than N/2+1, wherein the method for driving the display panel further comprises displaying a frame of the display panel, and the displaying the frame of the display panel comprises:

in a scanning period, progressively scanning pixels in the first row to the Nth row of the display panel and switching off the backlight of the display panel; and in a holding period, putting pixels in a respective row of the display panel in a holding state and switching on the backlight of the display panel.

2. The method of claim 1, wherein the transition period has a duration of 1 H-10 H, and 1 H indicates the time the display panel takes to scan a row of pixels while displaying a frame.

3. The method of claim 1, further comprising: switching off a backlight of the display panel in the transition period.

4. The method of claim 1, wherein n=1.

5. A driving device for a display panel, comprising:

gate driver circuits, wherein the gate driver circuits are electrically connected with gate lines of the display panel, and wherein the gate driver circuits are configured to switch on pixels in the nth row to the Nth row the display panel simultaneously in a transition period between displaying two neighboring frames to switch on a row of pixels, N is an integer and indicates a row number of the last row of pixel of the display panel, and n is an integer larger than 0 and smaller than N/2+1, each row of pixels corresponding with a respective gate line;

source driver circuits, wherein the source driver circuits are electrically connected with data lines of the display panel, and wherein the source driver circuits are configured to apply a voltage with the highest grayscale to pixels that are switched on in the transition period, and a displaying circuit for displaying a frame of the display panel and configured to:

in a scanning period, progressively scan pixels in the first row to the Nth row of the display panel and switch off the backlight of the display panel; and in a holding period, put pixels in a respective row of the display panel in a holding state and switch on the backlight of the display panel.

6. The driving device of claim 5, wherein the transition period has a duration of 1 H-10 H, and 1 H indicates the time the display panel takes to scan a row of pixels during displaying a frame.

* * * * *